US007803060B2

(12) United States Patent
Burrell

(10) Patent No.: US 7,803,060 B2
(45) Date of Patent: Sep. 28, 2010

(54) ROTARY STRIKING SURFACE ON A GOLF PUTTER

(76) Inventor: James S. Burrell, 2523 Echo Hill Dr., Norco, CA (US) 92860

( * ) Notice: Subject to any disclaimer, the term of this patent is extended or adjusted under 35 U.S.C. 154(b) by 0 days.

(21) Appl. No.: 12/229,573

(22) Filed: Aug. 25, 2008

(65) Prior Publication Data

US 2010/0048320 A1 Feb. 25, 2010

(51) Int. Cl.
*A63B 69/36* (2006.01)
*A63B 53/04* (2006.01)

(52) U.S. Cl. ..... 473/230; 473/330; 473/340

(58) Field of Classification Search ..... 473/230, 473/330, 340, 341, 251, 219, 226, 328
See application file for complete search history.

(56) References Cited

U.S. PATENT DOCUMENTS

| | | | | |
|---|---|---|---|---|
| 2,426,274 | A * | 8/1947 | Kramer | 473/230 |
| 3,044,781 | A | 7/1962 | Murphy | |
| D193,399 | S | 8/1962 | McGranaghan | |
| 4,688,799 | A | 8/1987 | Johnson | |
| 4,756,535 | A * | 7/1988 | Bradley | 473/230 |
| 5,172,915 | A | 12/1992 | Flis | |
| 5,207,721 | A | 5/1993 | Lobdell | |
| 5,362,056 | A | 11/1994 | Minotti | |
| 5,527,035 | A | 6/1996 | Marshall | |
| 5,544,887 | A | 8/1996 | Bryant | |
| 5,577,965 | A | 11/1996 | Burgess | |
| 5,643,098 | A | 7/1997 | Monahan et al. | |
| 6,066,053 | A | 5/2000 | Sehemberger | |
| 6,149,533 | A | 11/2000 | Finn | |
| 6,431,992 | B1 | 8/2002 | Moody | |
| 6,517,447 | B2 | 2/2003 | Buchanan | |
| 7,261,642 | B2 | 8/2007 | Blankenship | |
| 7,481,714 | B2 * | 1/2009 | Blanchard | 473/230 |
| 2004/0166950 | A1 | 8/2004 | Park | |
| 2005/0059505 | A1 | 3/2005 | Montalembert | |
| 2008/0064520 | A1 | 3/2008 | Rushe | |

* cited by examiner

*Primary Examiner*—Sebastiano Passaniti
(74) *Attorney, Agent, or Firm*—I. Michael Bak-Boychuk

(57) ABSTRACT

A putter club head is provided with an elongate cavity communicating to the exterior through a rectangular opening in the striking face thereof spaced above the club head lower surface that forms a lower shielding structure to deflect any growth in the course of a putting stroke. A conforming tubular segment is then mounted for rotation within the cavity to expose a portion of its peripheral surface beyond the plane of the striking face generally elevated above the bottom surface to a height corresponding to the elevation of the contact periphery of a golf ball resting thereon. In this manner little or no spin is imparted to the ball when struck by the roller since the lower club surface shields the roller from any moments imparted by the growth covering the green.

11 Claims, 2 Drawing Sheets

ROTARY STRIKING SURFACE ON A GOLF PUTTER

REFERENCE TO RELATED APPLICATIONS

No claim of a priority date earlier than the instant filing date is made.

BACKGROUND OF THE INVENTION

1. Field of the Invention

The present invention relates to golf clubs, and more particularly to improvements in the golf ball contacting portions of a putter.

2. Description of the Prior Art

Those engaged in the game of golf are well aware of the effect that the various mechanical aspects of the several golf clubs have on the number of strokes needed to drive a golf ball into the cup that lines the hole. Simply, the eventual score of one's game is not just determined by one's musculature and agility, but also by the kinematic properties of the golf clubs and in particular those of the putter by which most scoring differentials are amassed. What one usually wants for this part of the game is a club that suppresses and attenuates one's stroking mistakes while predictably providing the repeatable mechanics of a pendulum squarely striking an object (the golf ball) in the course of its swing.

Consequently most, if not all, golfers, when putting, often push the golf ball for some small amount of time in an attempt to better control the ball rather than strike the ball with an instant impact with the putter. When the ball is thus pushed it wants to roll but the flat surface of the face of the golf club creates friction and drag in the opposite direction that causes the ball to slow down, hop, and generally disturbs the roll of the ball.

The putting part of the golf game always entails the variables of the growth density of the green, how recently and closely it has been mowed, the various ground undulations and the associated growth directions thereof along with the irrigation practices of the golf course. All these impart varying levels of resistance to the movement of the club head through the growth and also the movement of the ball over the green which are then even further modified by any spin that may have been imparted to the ball as it was struck by the putter.

It is the foregoing variables that have troubled the committed golf player, resulting in various golf club structures that in one way or another seek to correct or reduce their effect. For example U.S. Pat. No. 6,066,053 to Schemberger; U.S. Pat. No. 5,643,098 to Monahan et al.; U.S. Pat. No. 5,362,056 to Minotti; U.S. Pat. No. 4,688,799 to Johnson; Des. 193,399 to McGranaghan; and many others describe club configurations provided with rollers that support the club head as it is moved over the ground, thus reducing the effect of varying growth. Alternatively, well rounded, smooth bottom surfaces have been proposed to limit the variable effect of grass resistance that may be imparted to the club, as in U.S. Pat. No. 6,149,533 to Finn; and U.S. Pat. No. 5,172,915 to Flis. While suitable for the purposes intended, each of the foregoing fails to control the variability of the spin imparted to the ball in the course of the club impact produced by the interfering growth bed on which the ball rests.

Those prior art references that have addressed the concerns over the imparted spin, as in U.S. Pat. No. 5,577,965 to Burgess, while also suitable for the purposes intended, expose the bottom parts of the rotary striking surface to the randomly distributed growth covering the green which then imparts its own variable spin reverse momentum to the ball, thus opposing the rolling momentum to reduce the distance of the put. A club configuration that consistently limits the sources for all imparted ball spin is therefore extensively desired and it is one such configuration that is disclosed herein.

SUMMARY OF THE INVENTION

Accordingly, it is the general purpose and object of the present invention to provide a cylindrical structure deployed above a shielding base plate of the club head of a putter and mounted for rotation in the club face to align its outer surface at an elevation substantially equal to the center elevation of a golf ball.

Other objects of the invention are to provide a rotary surface in the club face of a golf putter for minimizing the spin imparted to a golf ball when struck thereby.

Yet further and additional objects of the invention shall become apparent upon the examination of the specification that follows in conjunctions with the drawings attached.

Briefly, the foregoing and the other objects are accomplished within the present invention by providing a generally horizontal recess or cavity in the face of the club head of a golf putter in which a roller supported cylindrical segment is then mounted such that a radial portion thereof projects beyond the club face. The lower edge of the cavity that also forms the lower surface of the club head, extends subjacent the roller to form a partially extending protective rounded projection thereunder that sweeps aside or under any growth, thus limiting any torsional force couples imparted to the roller by such growth as the club is advanced to drive the roller exterior against the stationary ball.

Preferably the vertical position of the generally horizontal rolling axis and the exterior diameter of the cylindrical segment, together with the thickness of the projecting lower edge of the club, are all selected to vertically deploy the forward most portion of the segment at the height of the center of the stationary ball as it rests on the green. Moreover, the wall thickness and therefore the inertial mass of the roller segment are both minimized by known material removing machining techniques such that little rolling moment is imparted to the ball in the course of this contact. As result only the shear friction forces that are imparted by the growth to the lower surface of the ball as it is accelerated by the club head are the rolling forces imparted, closely duplicating the mechanics of a properly executed put.

In this manner the many bad golf swing habits that a golf player sometimes acquires are effectively suppressed since their perceived or desired effect is simply not achievable. As result the player can then direct his or her focus to the mechanics of a properly executed swing.

DESCRIPTION OF THE PREFERRED EMBODIMENT

Figure 1:
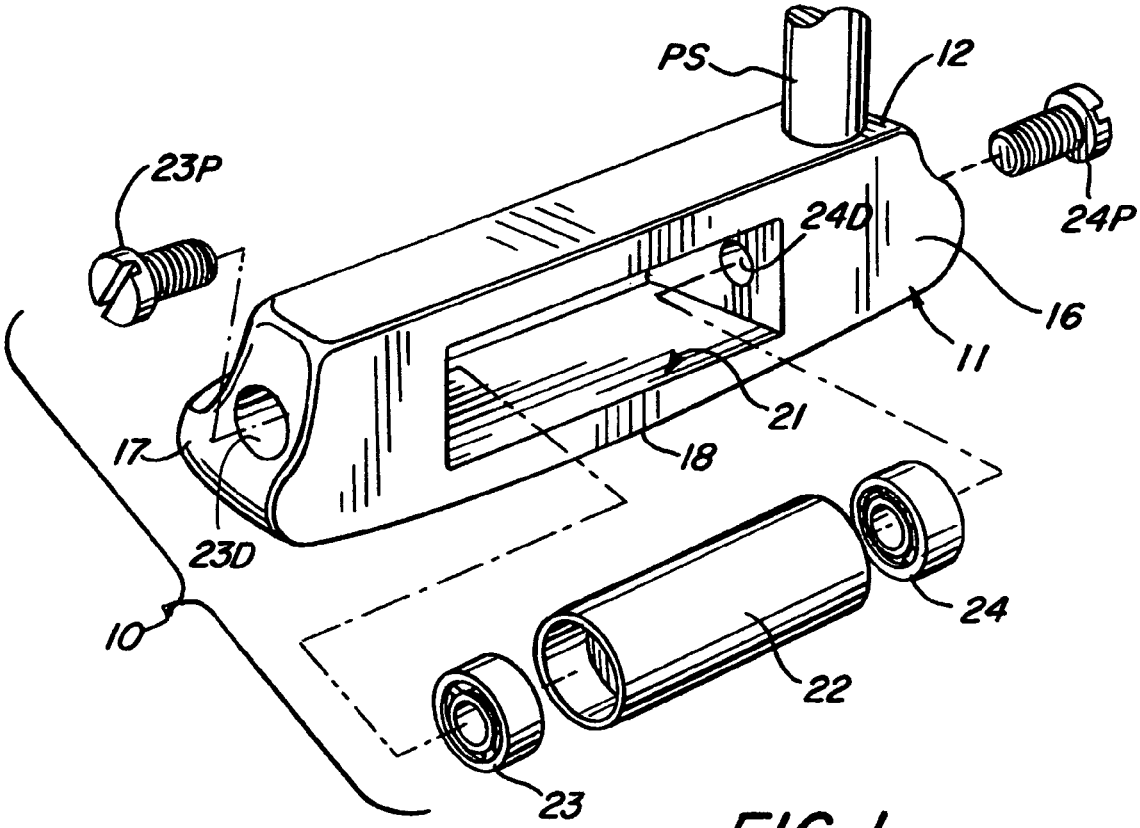
FIG. 1 is a perspective illustration, separated by parts, of the roller implemented club head of a golf putter in accordance with the present invention.
Figure 2:
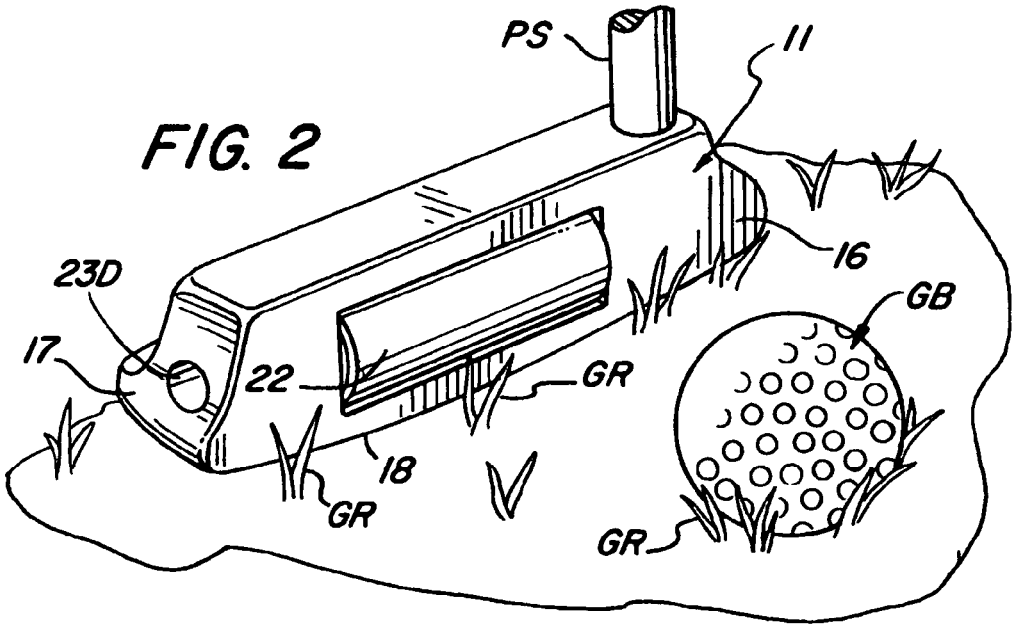
FIG. 2 is yet another perspective illustration of the inventive putter club head shown in FIG. 1, in its assembled form.
Figure 3:
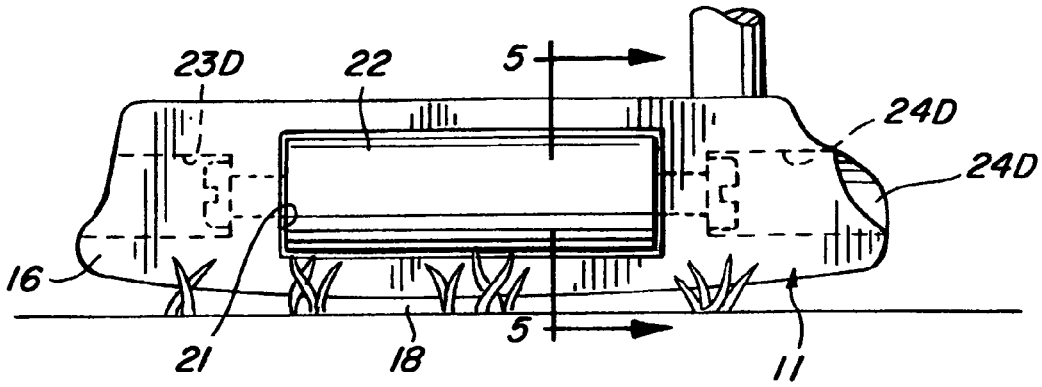
FIG. 3 is a front view of the putter club head constructed in accordance with the present invention.
Figure 5:
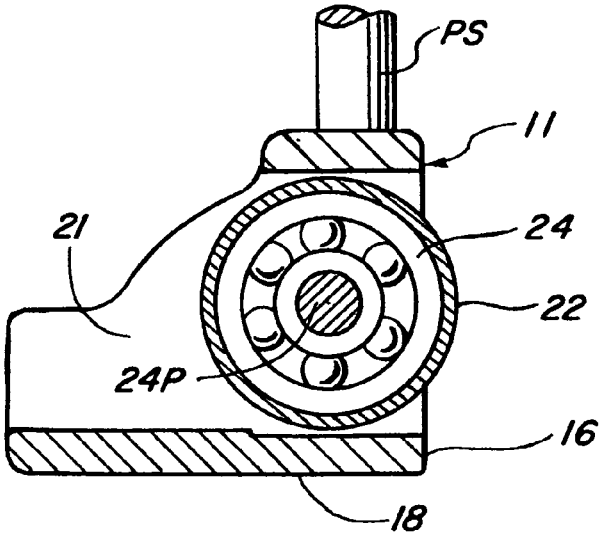
FIG. 5 is a sectional side view taken along line 5-5 of FIG. 3.
Figure 4:
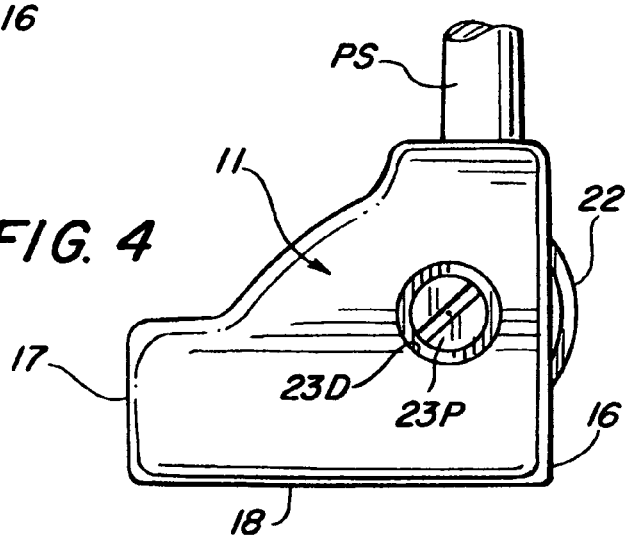
FIG. 4 is an end view of the inventive putter club head.

As shown in FIGS. 1 through 5, the inventive putter club head generally designated by the numeral 10 includes a club head structure 11 of a generally elongate form extending in cantilever from an attachment 12 at one end thereof receiving the free end of a putter shaft PS. In this general form the club head 10 is useful as the striking mass against a stationary golf ball GB resting on the growth GR that covers the surface of a golf green and in accordance therewith the club head structure 11 is defined by a generally vertical and forwardly directed face surface 16 for effecting this contact. Moreover, to maximize its various moments of inertia and thus minimize any perturbations to this striking stroke the club head structure also includes a generally horizontal rearwardly directed body 17 including a smooth, well rounded and faired lower surface 18 conformed to deflect and/or slide over any variations in the growth GR.

Those skilled in the art have long observed that even when thus properly weighted and aligned the semi-autonomous musculature of the user of the club will nonetheless attempt to compensate for any perceived stroking anomalies and will therefore often alter the stroke direction and alignment right at the point of contact. These higher frequency, small amplitude responses are a part of our active neuromuscular architecture and are therefore difficult to control other than by increasing inertias, weights and pendulum dimensions that so clearly characterize the tools of this game. Regardless of these mass increasing efforts the perturbations remain, resulting in contact dynamics that affect direction and, more importantly, randomly affect the spin imparted to the ball.

For the foregoing reasons the inventive club head structure 11 includes a generally rectangular and horizontally aligned cavity 21 formed in the forward face 16 and extending into the rear body 17 within which a conforming horizontally aligned cylindrical segment 22 is partly received to expose an arc segment of the exterior surface thereof beyond the plane of face 16. A pair of roller bearings 23 and 24 fitted into the ends of segment 22 support the segment on the ends of corresponding threaded pins 23P and 24P extending into the cavity through a pair of axially aligned, opposing threaded drillings 23D and 24D formed in the structure 11. Preferably, the mating fit between the bearings and the segment mounted thereon and also the extending ends of the threaded pins and the bearing centers are at a slight taper to reduce any looseness therebetween to provide the required solid feel to the club.

To obtain the desired vertical deployment of the major radial extension of segment 22 with the vertical height of the golf ball GB sitting on the growth GR the radial dimension of the segment is somewhat less than the radial dimension of the ball, with the thickness of the lower portion of structure 11 below cavity 21 generally then providing this desired height alignment. Of course, the lateral positioning of the cavity 21 along the cantilevered length of the club head 10 is then conventionally determined to match the desired 'sweet spot' that one obtains in a club.

In this manner a putter structure is obtained in which virtually all 'top spin' and even 'reverse spin' are eliminated, the low inertia, lightweight cylindrical ball-striking segment 22 absorbing most of this rotary input instead. As result those muscular imperfections that heretofore have been compensated by adding shaft length and club head mass are minimized, thus improving the control over the stroke.

Obviously many modifications and variations of the instant invention can be effected without departing from the spirit of the teachings herein. It is therefore intended that the scope of the invention be determined solely by the claims appended hereto.

I claim:

1. In a golf club defined by a club head mounted in cantilever on one end of a shaft conformed for the pivotal articulation of said club, said club head including a body having a lower surface and a striking face, said lower surface being conformed to pass above the ground surface and deflect the substantial part of any growth thereon in the course of a swinging articulation of the club with the striking surface aligned to strike a golf ball resting on said ground surface, the improvement comprising:

an elongate cavity formed in said body in a spaced generally parallel alignment above said lower surface and communicating to the exterior of said club head through a conforming opening in said striking face and defined by a lower structure including said lower surface for deflecting said growth; and a tubular roller mounted above said lower structure for rotation within said cavity in a projecting alignment of a peripheral portion thereof through said opening in said striking face.

2. In golf club according to claim 1, wherein:

said peripheral portion of said tubular roller projecting beyond said striking face is generally aligned at a height selected to effect contact with said golf ball.

3. In a golf club according to claim 2, wherein:

said lower structure is defined by the separation of said conforming opening in said striking face and said lower surface is of a dimension sufficient to shield said tubular roller from said growth on said ground surface.

4. In a golf club according to claim 1, the improvement further comprising:

said tubular roller including a first and second bearing each received in the corresponding one of the distal ends thereof; and said club head body includes transversely opposed securing posts releasably inserted in the corresponding ones of said bearings.

5. In golf club according to claim 4, wherein:

said peripheral portion of said tubular roller projecting beyond said striking face is generally aligned at a height selected to effect contact with said golf ball.

6. In a golf club according to claim 5, wherein:

said lower structure is defined by the separation of said conforming opening in said striking face and said lower surface is of a dimension sufficient to shield said tubular roller from said growth on said ground surface.

7. A putter club head useful in the course of striking a golf ball without imparting substantial spin thereto, comprising:

a generally elongate club head body provided with a planar striking surface at the forward edge thereof joined to a substantially planar lower surface conformed by fairing to deflect in the course of striking said golf ball by said striking surface any growth projecting from the ground adjacent thereto, said body further including an elongate cavity aligned in spaced relationship above said lower surface and communicating to the exterior through an opening in said striking surface and define by a lower structure including said lower surface for deflecting said growth; and a tubular roller mounted above said lower structure for rotation within said cavity in a projecting alignment of a peripheral portion thereof through said opening in said striking face, the remaining peripheral surface thereof being shielded from contact with said growth by said body.

8. A putter club head according to claim 7, further comprising:

said tubular roller including a first and second bearing each received in the corresponding one of the distal ends thereof; and said club head body includes transversely opposed securing posts releasably inserted in the corresponding ones of said bearings.

9. A putter club head according to claim 8, wherein:

said peripheral portion of said tubular roller projecting beyond said striking face is generally aligned at a height selected to effect contact with said golf ball.

10. A putter club head according to claim 9, wherein:

said putter club head is affixed to the end of a shaft whereby said body is advanced to strike said golf ball upon the manual articulation of said shaft with said lower structure including said lower surface being conformed to pass above the ground surface and deflect the substantial part of said growth thereon in the course of said manual articulation of the shaft.

11. A putter club head according to claim 10, wherein:

said opening communicating into said cavity is substantially rectangular.

* * * * *